US008269083B2

(12) United States Patent
Papenfus

(10) Patent No.: US 8,269,083 B2
(45) Date of Patent: Sep. 18, 2012

(54) STRING INSTRUMENT FRETS AND ASSOCIATED FRET OPTICAL APPARATUS

(76) Inventor: Erich Papenfus, Golden, CO (US)

( * ) Notice: Subject to any disclaimer, the term of this patent is extended or adjusted under 35 U.S.C. 154(b) by 0 days.

(21) Appl. No.: 12/751,857

(22) Filed: Mar. 31, 2010

(65) Prior Publication Data

US 2010/0186573 A1 Jul. 29, 2010

Related U.S. Application Data

(63) Continuation of application No. 12/114,854, filed on May 5, 2008, now Pat. No. 7,714,218.

(51) Int. Cl.
*G10D 3/06* (2006.01)

(52) U.S. Cl. ..... 84/314 R

(58) Field of Classification Search ..... 84/314 R
See application file for complete search history.

(56) References Cited

U.S. PATENT DOCUMENTS

| | | | | |
|---|---|---|---|---|
| 3,712,952 | A | 1/1973 | Terlinde | 84/314 R |
| 376,987 | A | 11/1973 | Cawthorn | |
| 3,769,871 | A | 11/1973 | Cawthorn | 84/291 |
| 3,943,815 | A * | 3/1976 | Gilbert | 84/293 |
| 430,878 | A | 1/1982 | Eizonas | |
| 4,308,784 | A | 1/1982 | Eizonas | 84/452 R |
| 465,869 | A | 4/1987 | Aitken et al. | |
| 4,807,509 | A | 2/1989 | Graham | 84/314 R |
| 496,938 | A | 11/1990 | Decker, Jr. et al. | |
| 4,977,808 | A | 12/1990 | Thacker | 84/291 |
| 522,757 | A | 7/1993 | Cipriani | |
| 5,227,571 | A | 7/1993 | Cipriani | 84/307 |
| 526,749 | A | 12/1993 | Othon | |
| 5,267,499 | A | 12/1993 | Othon | 84/291 |
| 598,619 | A | 11/1999 | Wolff et al. | |
| 5,986,190 | A * | 11/1999 | Wolff et al. | 84/297 R |
| 612,091 | A | 9/2000 | Szenics | |
| 626,235 | A1 | 7/2001 | Murray | |
| 7,312,388 | B2 | 12/2007 | Oskorep | 84/322 |
| 7,368,646 | B2 * | 5/2008 | Payung | 84/290 |
| 7,427,707 | B2 | 9/2008 | Shaffer | 84/464 A |
| 2001/0029827 | A1 | 10/2001 | Chapman | 84/314 R |
| 2003/0140765 | A1 | 7/2003 | Herman | |
| 2004/0040432 | A1 * | 3/2004 | Erickson et al. | 84/306 |
| 2005/0172785 | A1 | 8/2005 | Fisher-Robbins et al. | 84/464 R |
| 2008/0190264 | A1 | 8/2008 | Jones et al. | 84/314 R |
| 2009/0272248 | A1 * | 11/2009 | Papenfus | 84/314 R |
| 2010/0186573 | A1 * | 7/2010 | Papenfus | 84/314 R |

OTHER PUBLICATIONS

Frets, citations of traditional sizes of frets by B. Hefner Company on Fender fret sizes, viewed Jun. 9, 2009.

Stephen's Guitar Specifications, dimensions for the various parts on a guitar, including fret dimension and neck widths, © 1996 Stephens Stringed Instruments by Stephen's Stringed Instruments.

Mohs Hardness Test, provides a reference on mineral hardness, first developed by Frederick Mohs (1773-1839) and the position of quartz as a relative hardness of 7.

* cited by examiner

*Primary Examiner* — David Warren
*Assistant Examiner* — Robert W Horn
(74) *Attorney, Agent, or Firm* — Albert Haegele; Leyendecker & Lemire, LLC

(57) ABSTRACT

An instrument comprising a body, a neck and a plurality of strings. The neck comprises a first end having a headstock, a fretboard, at least one mineral fret coupled to the fretboard, and a second end one of coupled and integrated to the body. The mineral fret may be generally transparent.

17 Claims, 5 Drawing Sheets

STRING INSTRUMENT FRETS AND ASSOCIATED FRET OPTICAL APPARATUS

CROSS-REFERENCE TO RELATED APPLICATIONS

This application is a continuation of and claims priority to U.S. Nonprovisional patent application Ser. No. 12/114,854 filed May 5, 2008, the full disclosure of which is incorporated herein by reference. The aforementioned nonprovisional patent application has the title "String Instrument Frets and Associated Fret Optical Apparatus," and has the same named inventor as the present application.

FIELD OF THE INVENTION

This invention generally relates to stringed instruments having frets.

BACKGROUND

A string or "stringed" instrument is a musical device that produces sound by vibrating bands of stretched material. The bands are referred to as the strings. The sound created by the vibrating strings is transferred to a main body of the instrument or to a pickup in the case of an electronically-amplified instrument, eventually resonating to the air.

Many stringed instruments include a neck. The neck is a part of the instrument that projects from the main body and may include a fingerboard, which may also be known as a fretboard. One fingerboard may be a thin, long strip of wood, laminated or otherwise coupled to a front of the neck below where the strings are typically stretched across. One type of fingerboard may be a fretted fingerboard. A fretted fingerboard is a fingerboard comprised of frets, which are typically raised thin strips of hard metal material, such as stainless steel or a nickel alloy like nickel-silver. Frets are typically aligned substantially perpendicularly to the stretched stings and divide a stringed instrument neck into fixed segments at intervals related to a musical framework.

These thin strips of metal are adapted to help transfer the sound of the vibrating strings to the instrument body or pickups. This occurs by pressing a string against a fret and subsequently exciting the string portion between the fret and the body. By attaching frets to a neck, a musician may more easily stop the string in the same place than if a neck without frets was used, thereby more easily playing the same notes. Although frets are often fixed, as in a guitar or mandolin, they may be movable as well, as on a lute. Another benefit of using frets is that they allow for less dampening of the string vibration than would happen if a string was pressed directly against the neck and fingerboard.

As frets allow instrument strings to vibrate or resonate for a longer period of time than without frets, the frets help provide tone definition to the instrument. As prior art fretted stringed instruments typically use only metal frets, the tonal quality of these instruments is generally stagnant and is typically only modified by modifying other aspects of the stringed instrument such as, but not limited to, the body size and shape, the string thickness, or by implementing pickup modifications. Musicians are always looking for the latest developments in string instruments in order to produce novel tones in their music. These changes in tone and sound have been regularly sought. One example of this is the fact that many Rock-and-Roll guitarists use both Gibson Les Paul and Fender Stratocaster guitars as these models tend to produce tones unique unto each model.

In addition to seeking variety in the tone associated with stringed instruments, musicians also seek variety in the visual presentation of their instrument. For example, a flying-v guitar model presents a different look to an audience than a typical Fender guitar model or a Gibson guitar model. Optical presentations are often sought by musicians in order to increase the perceived entertainment value of the performance by the audience. Therefore, musicians often present graphical displays on the body of their instruments, and many rock-and-roll and other musicians of various genres use an array of multicolored lights and lasers to provide visual stimulations to the audience. As audiences often purchase tickets to musical presentations in order to view the latest in visual and optical presentations, as well as to hear the music, it is often a necessity for musicians to seek, obtain, and display these visual and optical presentations for their audiences less their audience choose to purchase concert tickets to other musicians displaying such novel presentations, devices, and sounds.

DETAILED DESCRIPTION

Figure 1:
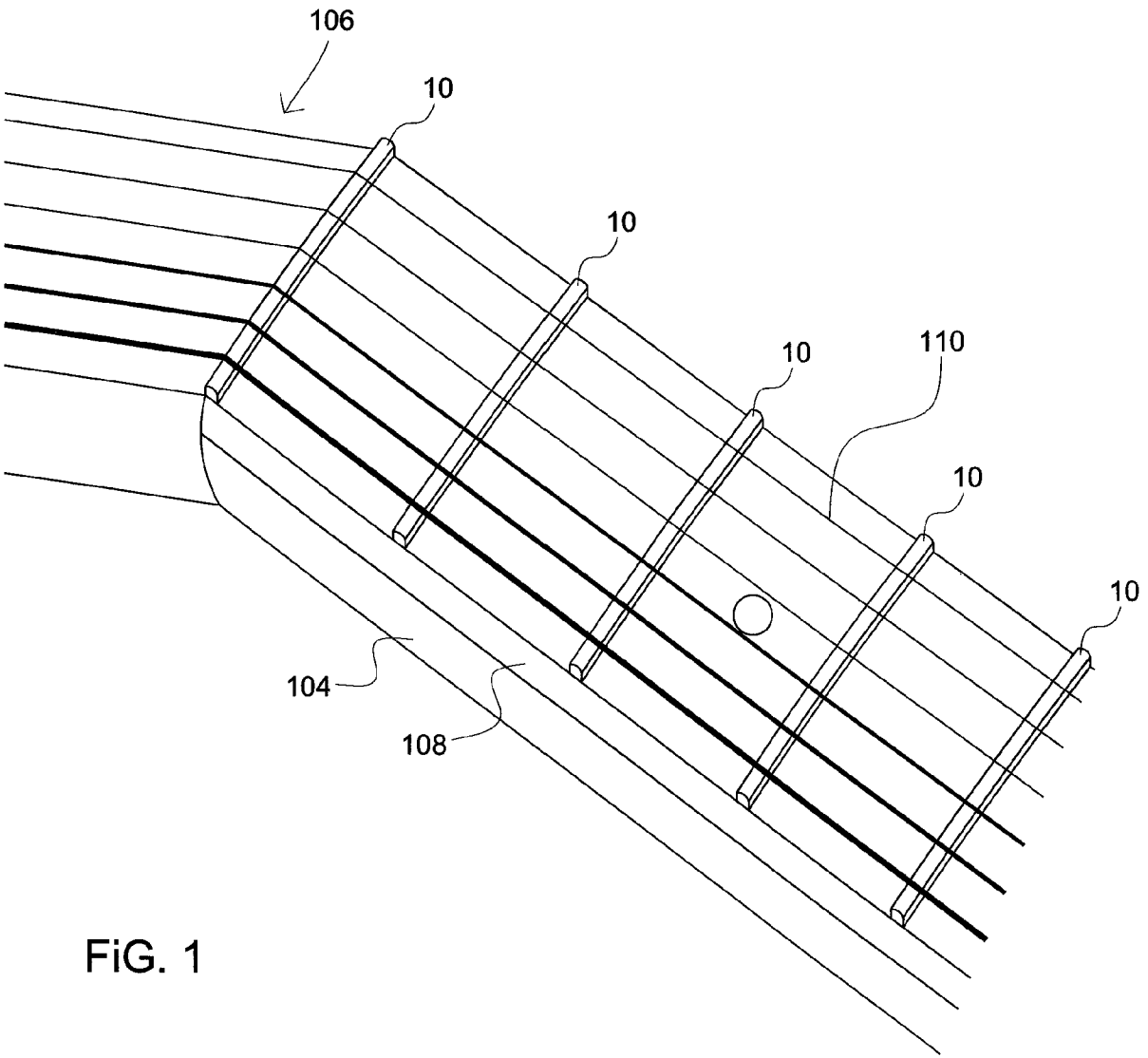
FIG. 1 is a close-up isometric view of a portion of a guitar neck comprising generally transparent mineral frets having at least one holographic image according to one embodiment of the invention.

To provide musicians with a string instrument that produces a different sound and tonal quality, as well as to provide musicians new visual and optical characteristics of a string instrument, embodiments of a string instrument having mineral frets and associated optical apparatus has been developed. One embodiment of a stringed instrument with mineral frets may be comprised of quartz crystal frets, although embodiments having non-crystal or non-quartz frets are also contemplated. All types and variations of quartz and other minerals are contemplated being implemented. Furthermore, although one embodiment of a quartz stringed instrument comprises an electric guitar having quartz frets, other stringed instruments such as, but not limited to violins, are also contemplated.

A string instrument having a fretboard with frets comprised of quartz or another type of mineral may provide the musician with an alternative sound to the same instrument with metal frets. For example, one stringed instrument having a fret comprised of a first type of quartz or other mineral may produce a higher pitch than a metal fretted instrument, while a stringed instrument having a fretboard with a second type of quartz or other mineral may produce a lower pitch than a metal fretted instrument. An additional feature of an embodiment of quartz and other mineral-fretted instruments is that while metallic frets may change string frequency resonation, thereby emitting less of a pure tonal quality, quartz frets may not change string frequency resonation emitting a frequency closer to a pure tone. Providing this functionality in a string instrument may, for example, allow a guitarist to obtain a sound similar to both the Fender and the Gibson guitar models on a single guitar.

Creating different string frequency when using mineral frets may allow musicians with an ability to generate new sounds. For example, clearer sounds may be generated with quartz frets than is possible with a standard metal-fretted stringed instrument. This may be possible as quartz frets may substantially remove the metallic sound and distortion generated through the use of metal frets. Therefore, using quartz frets may provide an ability to produce a live high-definition type of sound with a generally analog instrument (this may be a sound having a more pure tonal quality). An additional feature that may be available through the use of quartz frets is sustaining the sound and tone emanated from the stringed instrument for a longer period than with a metallic fret.

In one stringed instrument embodiment having quartz frets, when a string or a series of strings are pressed against the fret or frets and then resonation is induced, the frequency or amplitude of the string or strings may initially increase. The frequency or amplitude may level after the increasing period, substantially sustaining that frequency or amplitude level for a period of time. Subsequent to the sustained period, the frequency or amplitude may decay and decrease. This provides a different type of audio experience for persons listening to a stringed instrument having quartz frets that metal frets as the frequency or amplitude with metal frets may decay immediately or nearly immediately upon the initial exciting of the string.

Besides having different tonal qualities than metal fretted instruments, stringed instruments having mineral frets may also provide increased optical qualities. For example, some quartz frets may be generally or substantially transparent or translucent. When such a quartz fret is used, the fret may reflect or refract light in a manner different than a metal fret under the same light source. Furthermore, having a generally or substantially transparent or translucent fret may allow a musician to display a holographic image in a unique manner or may allow the musician to display a light source on the guitar neck—such as displaying a fiber-optic or a L.E.D. light source embedded on the neck or otherwise.

By using a guitar having one or more mineral frets, these above described audio and visual enhancements can be provided to stringed instruments. Therefore, musicians using mineral fretted stringed instruments can provide an increased number of tonal ranges and visual representations to their audiences. By offering these increased tonal ranges and visual experiences in their live performances and having increase tonal ranges on their recorded music, the musicians may sell more concert tickets and they may increase the sales of their recorded music.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, tense or any singular or plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of phrases like "in one embodiment", "in an embodiment", or "in a variation" in various places in the specification are not necessarily all meant to refer to the same embodiment or variation.

The term "couple", "coupled", "coupling", or any variation thereof, as used in this specification and the appended claims refers to either an indirect or direct connection between the identified elements, components or objects. Often the manner of the coupling will be related specifically to the manner in which the two coupled elements interact. Specifically, this term may be used to define tow elements joined by a bolted fastener, a latch, a hook, or any other reasonably readily removable fastening device.

The term "integrate" or "integrated" as used in this specification and the appended claims refers to a blending, uniting, or incorporation of the identified elements, components or objects into a unified whole.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

The terms "pitch", "tone", "sound" and any similarly associated versions of these terms as used herein refer to the perceived or actual frequency of a note played by an instrument. The pitch, tone, and sound of an instrument may depend on the amplitude at which the note is played. Furthermore, the terms do not refer to any one particular note but generally refer to the full range of notes that may be perceived by a listener unless otherwise stated. Additionally, these terms do not specifically refer to "pure tone"—a single frequency tone with no harmonic content (no overtones), unless otherwise noted or alluded to.

The terms "distortion", "overtones", "chatter", "noise", and any generally related terms refer to unwanted tones, sounds, or frequencies in any frequency or sound emitted from an instrument.

The terms "holography" and "hologram", or any variations thereof used herein refer to any type of three-dimensional photography, two-dimensional multilayer images, and volumetric displays. The term most often refers to two and three layer 2D images stacked in such a way that each layer is alternately visible depending upon the angle of perspective of the viewer.

One Embodiment of a Stringed Instrument Fret

Figure 3:
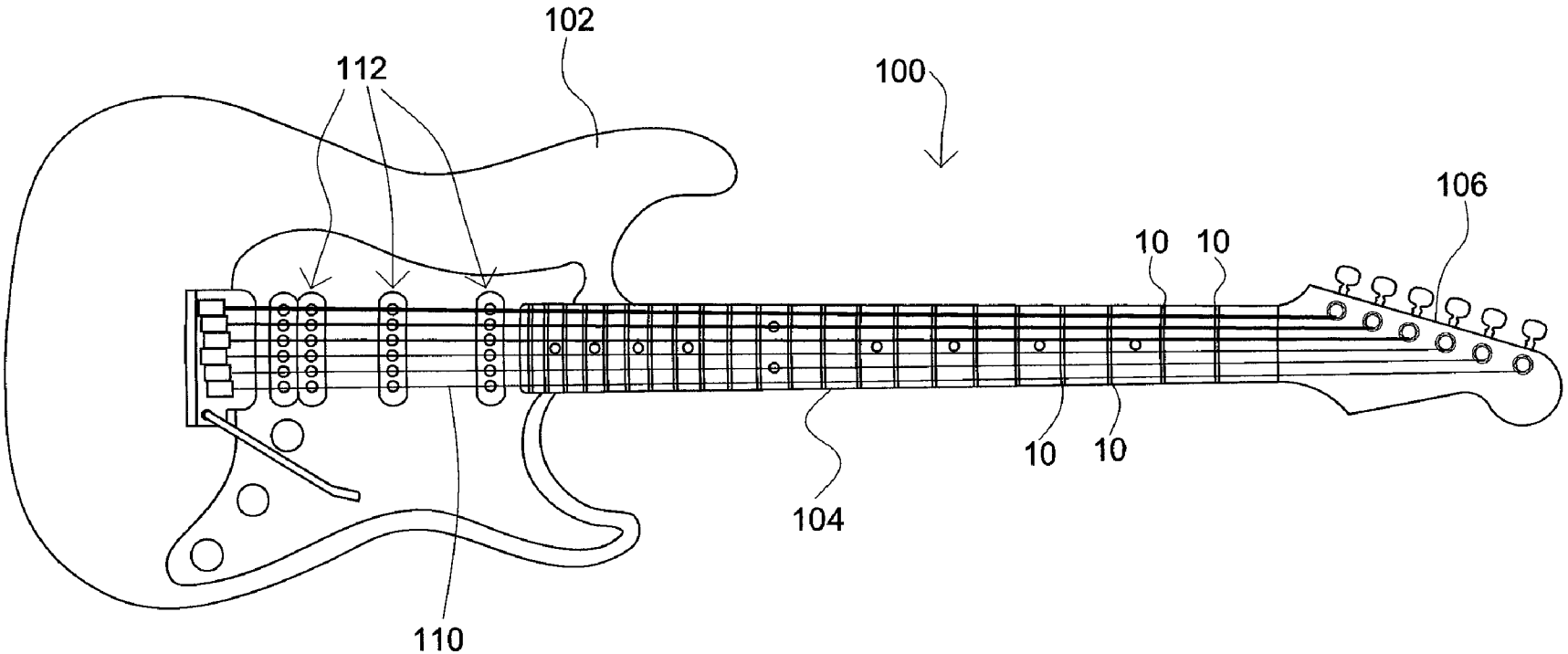
FIG. 3 is a top view of an instrument having a plurality of mineral frets and at least one pickup according to one embodiment of the invention.

As best shown in FIG. 3, one embodiment of a stringed instrument 100 comprising a plurality of mineral frets 10 is generally similar to a stringed instrument having metallic or otherwise non-mineral frets. One embodiment of the current invention may only be comprised of one or more quartz frets and one or more non-quartz frets. A string instrument having one or more quartz frets may also comprise a body 102, a neck 104 and a plurality of strings 110. The neck may be comprised of first end having a headstock 106, a fretboard 108, and the frets, as best shown in FIG. 1. A neck second end may be coupled or integrated to the body.

One embodiment of a string instrument 100 creates sound through vibrating the strings 110 of the instrument. In an acoustic string instrument such as, but not limited to, an acoustic guitar, the resonation of the strings is transferred to the body 102 of the instrument. The hollow body is able to amplify the sound produced by each individual string resonation, creating the musical note. In an electric string instrument such as, but not limited to, an electric guitar, pickups 112 are used to transfer the string resonation to a loudspeaker in order to amplify the sound One type of pickup comprises a magnet or a series of magnets surrounded by a coil of wire. When a vibration in a metallic string near the magnet occurs, the pickup's magnetic field is disrupted. This magnetic flux causes an electrical charge in the wire. This electrical signal is then transferred through the wire to the loudspeaker which operates to convert the electrical signal to sound.

Differences in the string 110 resonation create different electrical charges, so even small changes in string resonation and frequency may ultimately produce a different sound. In one embodiment, this change in string resonation and frequency may be created through changing the fret 10 material to quartz or any other mineral with sufficient hardness. Hardness can be important in selecting various minerals in order to minimize the wear & tear on the frets and thereby minimize the amount of fret replacement that is required, as well as to provide different tonal qualities. For example, quartz, otherwise known as Silica or $SiO_2$, has a hardness of 7 on the Mohs scale. Turquoise, having the chemical formula $CuAl_6(PO_4)_4(OH)_8 4H_2O$, may also be used in some embodiments, although turquoise only has Mohs Scale hardness of 5 to 6. Other transparent, translucent or generally transparent and translucent minerals, such as, but not limited to, diamonds and hematite (also known as Iron oxide or $Fe_2O_3$), may also be used. Diamonds have a hardness of 10 on the Mohs Scale and hematite has a hardness of about 5.5 to 6.5. This hardness scale essentially defines the scratch resistance of the mineral to other minerals. Synthetic quartz may also be used.

Implementing non-metallic frets 10 generally comprised of minerals may change the sound of one embodiment of a string instrument 100. A prior-art string instrument having metallic frets may produce a sound different than what is produced with an embodiment having mineral frets. This may be due to a string resonating at a different frequency with a quartz or mineral fret than when a substantially similar string is resonated in a substantially similar manner with a metal fret. occur because when A string 110 may be resonated through pressing the string against a metal fret and subsequently exciting (such as, but not limited to, through plucking), the string. High quality white or colorless quartz from Brazil, Pakistan, or Arkansas having a hardness of about 7 may be used in one embodiment.

A metallic fret 10 may cause a different frequency in a string 110 and ultimately on a different sound upon excitement than a mineral fret because when a string is excited the metal fret itself may resonate at a frequency different than the frequency the mineral fret resonates at. This difference in fret frequency between the two materials may cause a slight variation in string frequency, thereby creating a different sound. The sound produced by the mineral-fretted instrument may be a clearer sound, having less background noise and distortion, and may be closer to a pure tone. This may be because the metal fret may resonate at a different frequency than the metal string and this fret resonation than the metal fret may be induced into the string, thereby inducing "chatter" in the signal. A mineral fret, on the other hand, may have a lower frequency amplification resonation or may resonate at a frequency closer to the frequency of the string and therefore may induce less background noise into the string resonation, which may allow a sound closer to a pure tone to be picked up by the magnetic coil. Therefore, sounds emitted with the use of the mineral fretted instrument may more closely approximate the pure tone of the note. As such, some mineral-fretted instruments may produce a "high definition" type of sound.

Furthermore, the sound created with one quartz fret embodiment on a Fender model guitar may produce sound similar to a Gibson model guitar. A musician may therefore wish to have two guitar necks for a Fender guitar in order to swap between the metal-fretted Fender-sounding neck and the mineral-fretted Gibson-sounding neck. Therefore, he could have one guitar to produce both sounds.

An additional reason that less chatter and noise may be created through the use of quart frets 10 is because of the piezoelectric properties of quartz. Quartz develops an electric potential upon the application of mechanical stress. This resonant frequency of the quartz fret may be changed by changing the mechanical loading. Therefore, as a string is pressed against a quartz fret, the fret may induce a frequency into the string. Like other fret resonation, this frequency may be transferred to the pickup.

One fret frequency transfer to a string may be a higher frequency, which may lead to a higher resulting pitch in the instrument. However, lower frequencies and pitches are also contemplated. For example, one stringed instrument having a fret comprised of a first type of quartz or another mineral with a hardness of about 7 or higher may produce a higher pitch than a metal fretted instrument, while a stringed instrument having a fretboard with a second type of quartz or mineral with a hardness lower than 7 may produce a lower pitch than a metal fretted instrument. The inverse may also be possible here.

The frets 10 of one embodiment are coupled to the fretboard 108, as best shown in FIG. 1. The frets may be coupled through an adhesive, although other coupling mechanisms such as, but not limited to, snappably coupled frets are also contemplated. In one embodiment, the adhesive may be comprised of a hardener and a resin. One type of hardener may be comprised of Nonyl Phenol, Polyoxyalkyleneamines, and N-Aminoethylpiperazine. Crystal Sheen high gloss polymer finish HARDENER, manufactured by Environmental Technology Inc., of Landing Ga. may be used in one adhesive embodiment. One type of resin may be comprised of Bisphenol A/epicholorohydrin resin and aliphatic and aromatic glycidyl ethers. Crystal Sheen high gloss polymer finish RESIN, manufactured by Environmental Technology Inc., of Landing Ga. may be used in one adhesive embodiment.

Figures 2A, 2B, 2C:
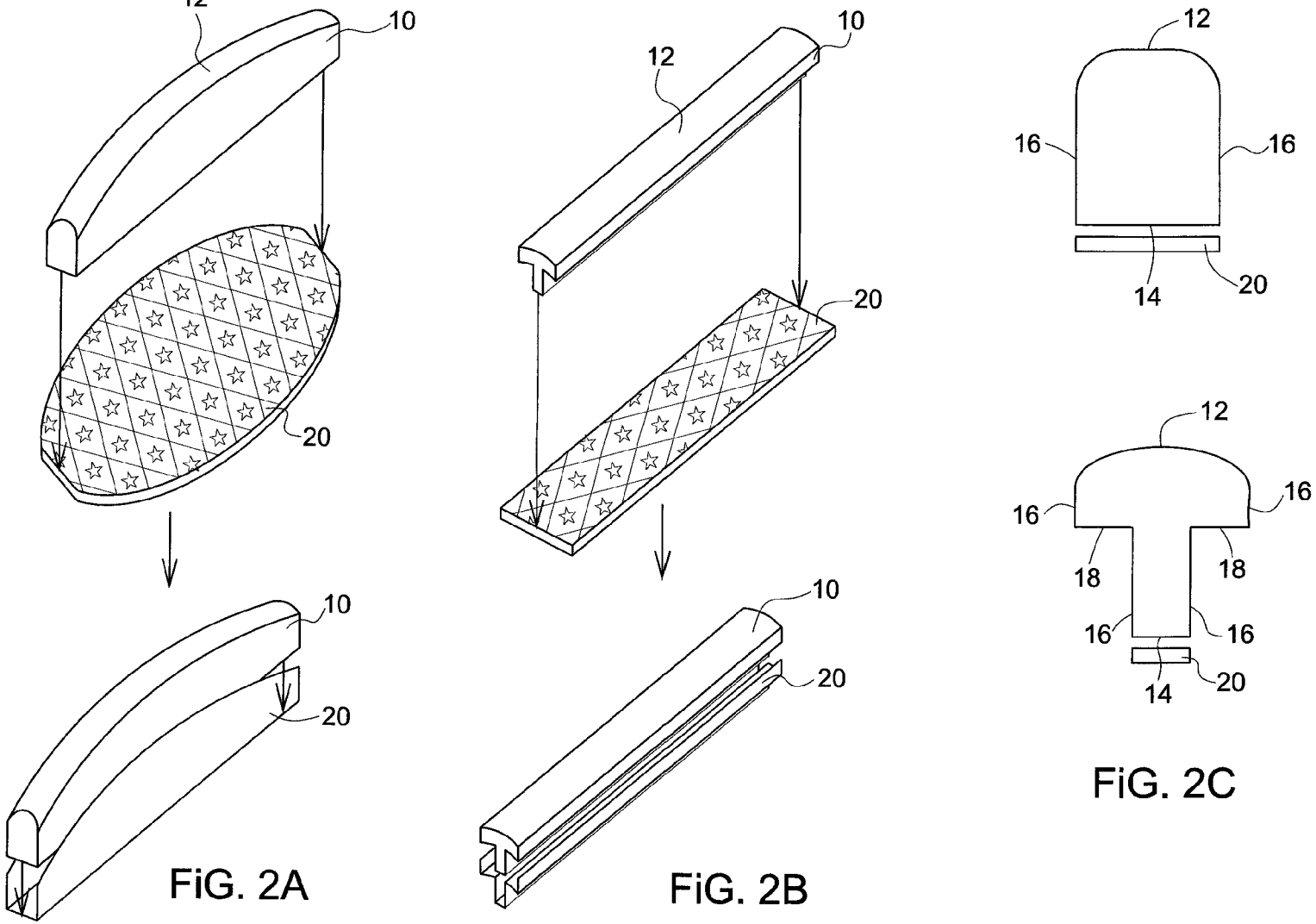
FIG. 2A is an isometric view showing how a first mineral fret may couple to a first holographic paper according to one embodiment of the invention.
FIG. 2B is an isometric view showing how a second mineral fret may couple to a second holographic paper according to one embodiment of the invention.
FIG. 2C is a side view of a first and second mineral fret and holographic paper according to one embodiment of the invention.

As best seen in FIG. 1, one fretboard 108 may be coupled to a front side of the neck 104. The fretboard may be adhesively coupled to the neck. On one fretboard, the size of a fret may preferrably be from about 1.5 inches to about 2.5 inches long, ⅙ to ¼ inches wide, and ⅛ to 1/32 inches thick, depending on the size of the size of the guitar neck. Smaller and larger frets may be used. Furthermore, as best shown in FIGS. 2A and 2B, a first embodiment of a mineral fret may have a generally convex top surface 12. Also, as best shown in FIG. 2B, a second embodiment of a mineral fret may also have a cross-sectional area resembling a capital "T".

A First Embodiment of an Optical Apparatus

As best shown in FIGS. 2A and 2B, a first embodiment of a fret optical apparatus comprises holographic paper 20 coupled to a fret 10 in order to display the holographic image or images on the paper through the fret. Holographic paper may be comprised of pulp-based paper, but may also be comprised of a polymeric material. FIG. 2A displays a first holographic paper shape adapted to couple to a first mineral fret while FIG. 2B displays a second holographic paper shape adapted to couple to a second mineral fret. Other sizes and shapes of frets and paper are contemplated. Other embodiments may have frets with embedded holographic images or may have other mechanisms adapted to display the holographic image through or proximal the fret. In one holographic fret embodiment, the holographic paper is coupled to the fret through an adhesive. In one adhesive embodiment, the adhesive may be placed on the paper, the fret, or both, prior to coupling the paper to the fret. Upon applying the adhesive, the paper is placed against the fret and fret is subsequently coupled to the fretboard. In one embodiment, the fret may be coupled to the fretboard or neck after the paper is first coupled to the fretboard or neck.

In one embodiment, the holographic paper 20 is generally placed against all surfaces of the fret 10 except the fret top surface 12, as best seen in FIGS. 2A and 2B. In other embodiments, the holographic paper may only be placed against a lower bottom surface 14, as best seen in FIG. 2C. In still other embodiments, the holographic paper may be placed against the lower bottom surface and any upper bottom surface 18. The purpose of the placement of the holographic paper in one embodiment is to maximize the display of the holographic image or images on the paper when the fret is illuminated so that person's in the audience during a concert can see the frets and image.

In one embodiment, the fret may be illuminated through the use of an external light source. In such an embodiment, a generally transparent fret may be used. Therefore, when the holographic paper is coupled to the fret and then the paper/fret combination is coupled to the instrument, when a light from an external light source enters the fret through the fret top surface 12, the light illuminates the holographic image in the fret, creating a fret which appears to glow and emanating the holographic images from within the fret. External light may also enter and illuminate the fret through a side or bottom surface.

A Second Embodiment of an Optical Apparatus

A second embodiment of an optical apparatus may be comprised of a light source. One type of light source may be a light-emitting diode, or LED, a fiber optic cable or a combination of the two. The fiber optic cable may receive its light source from an LED, natural light or artificial light other than an LED. As best see in FIG. 4, one embodiment of a string instrument 100 may be comprised of a truss rod 120. One truss rod may run a substantial length of the neck 104.

In one embodiment, the truss rod 120 may be removed from the neck and a light source may be embedded into the truss rod channel. For example, one or more fiber optic cables may be installed into the neck, with one end of the cable being located near a fret 10. One or more bore holes 122 may be drilled or otherwise placed into the neck. One end of a bore hole may be located proximal the truss channel where the rod was removed from and an opposing hole end may be located proximal a fret 10. In one embodiment, the fiber optic cable or an LED may be placed proximal the bore hole. Therefore, when the LED or fiber optic cable is illuminated proximal the fret, the light will reach the fret through the bore hole and if the fret is generally transparent, the fret will receive the light and become illuminated. In one embodiment, the fret may glow the color of the light emitted from the light source. An embodiment is also contemplated that may not use the truss channel. In such an embodiment, the light source may be inserted into the neck proximal the fret prior to the fret being installed onto the neck or a bore may be drilled into the neck at a different location.

The light source may be powered through operation of a switch. In one embodiment, the switch may be located on the body of the instrument, although other locations are also contemplated.

Figure 4:
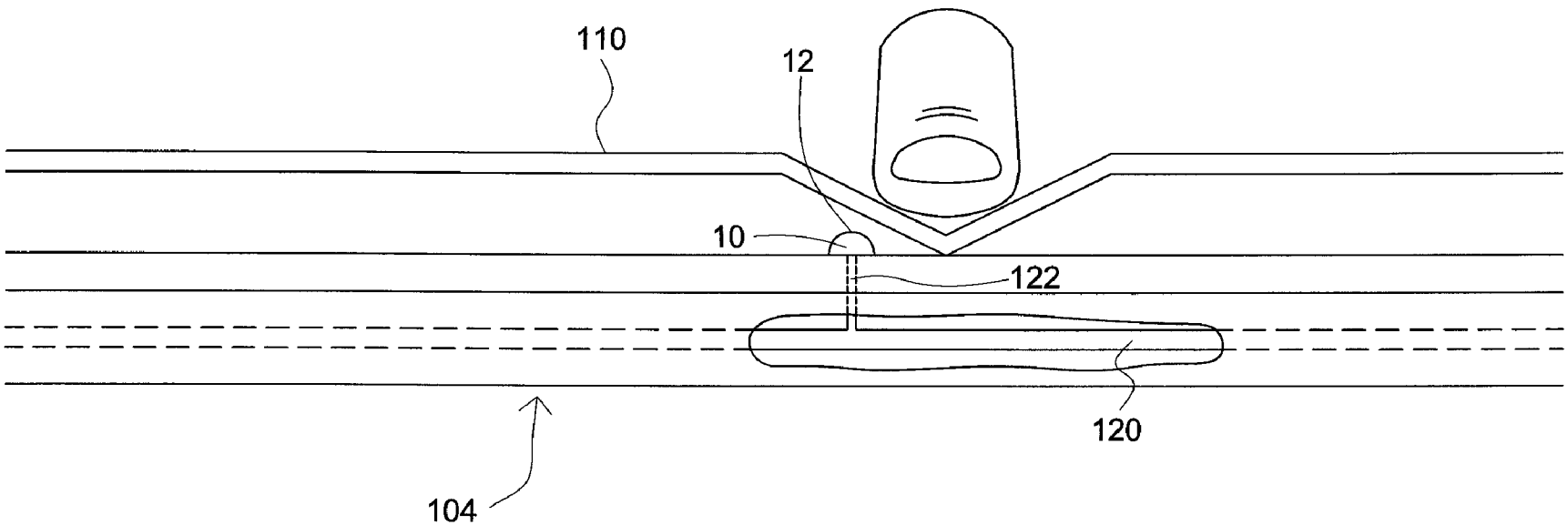
FIG. 4 is a side view of a portion of a string instrument with a string being pressed against a fretboard proximate a mineral fret and a cut-away portion showing the truss rod and bore hole according to one embodiment of the invention.
Figure 5:
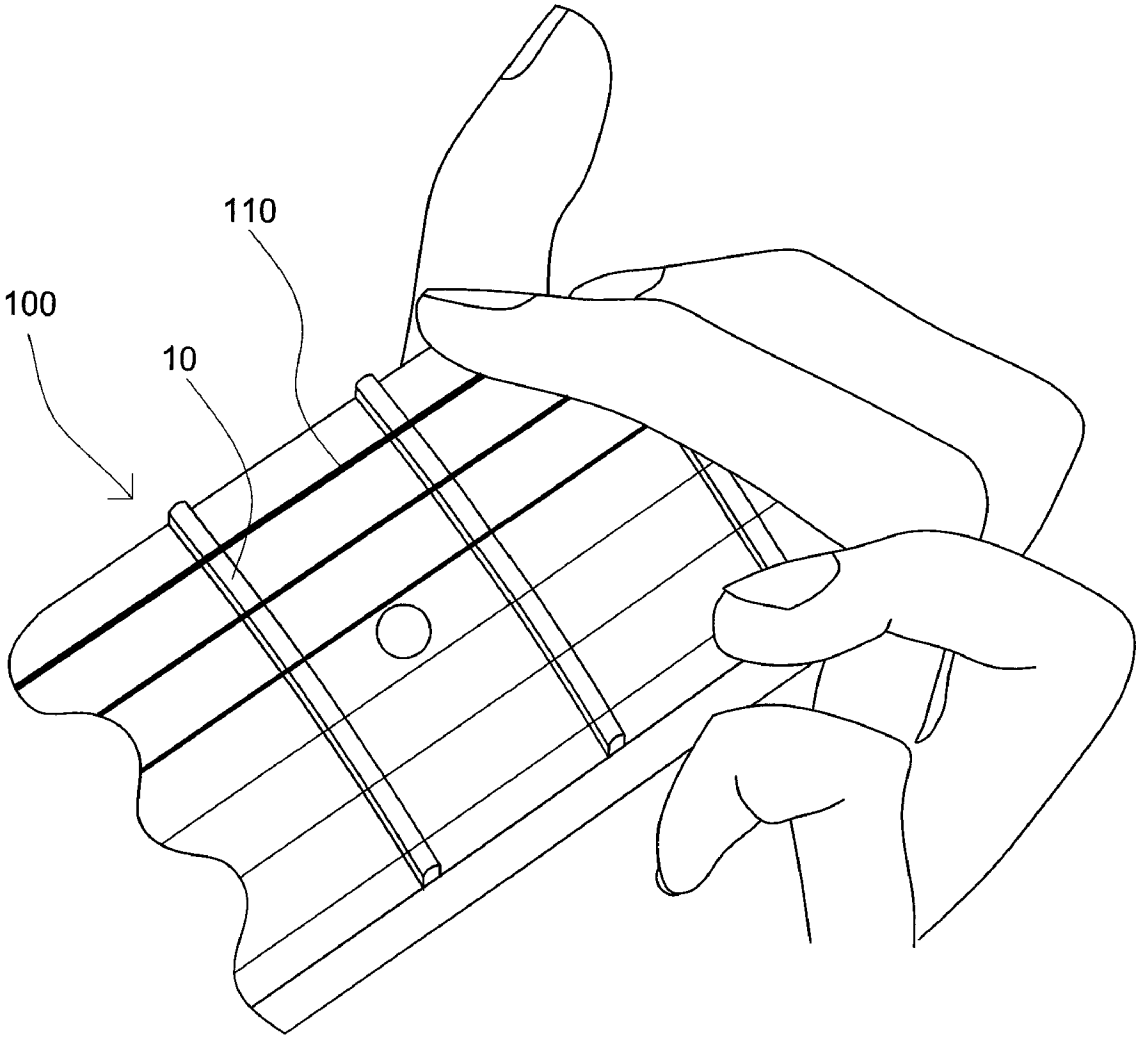
FIG. 5 is an isometric view of a portion of a string instrument showing how strings may be pressed against mineral frets and excited according to one embodiment of the invention.

A Method of Playing an Instrument Comprising:

As best seen in FIGS. 4 and 5, one method of playing an instrument 100 may be comprised of (i) using at least one finger to press a portion of a string 110 against at least one generally transparent mineral fret 10, and (ii) exciting the string. In one method, the string or strings may be excited through plucking. However, other string excitement methods generally known in the art are also contemplated. Furthermore, in one method, the at least one generally transparent mineral fret may be a quartz fret.

In one method, upon being excited, the string 110 may resonate at a different frequency when using a mineral fret 10 than when a metallic fret is used and the string is excited in substantially the same manner. This may be due to the mineral fret resonation having a lower amplification than a metal fret frequency amplification. The mineral fret may also resonate at a frequency closer to the frequency of the string resonation and therefore may induce less background noise into the string resonation. This may allow tones closer to pure tones to be produced with mineral frets such as, but not limited to, quartz frets. Higher quality sound may also be produced with a quart fretted instrument because of the piezoelectric properties of quartz.

In one method, metallic strings 110 and a magnetic pickup 112 may be used. In such a method, when at least one string 110 is pressed against at least one mineral fret 10 such as, but not limited to, a quartz fret, and the string is subsequently excited through plucking or otherwise to create a string resonation frequency, the frequency in the string may operatively create a sound having less distortion, or overtones, than a string resonated in substantially the same manner when in contact with a metallic fret. Furthermore, one method of resonating a string with a mineral fret may vibrate the string for a longer time period than substantially similar resonation with a metallic fret. Similarly, pure tones, or tones with a near optimal frequency, may be able to be sustained for a longer period of time with mineral frets than with non-mineral frets such as, but not limited to, metallic frets One generally transparent fret 10 in one method may be adapted to receive light and refract the light entering the fret. For example, the light may enter through a fret top surface 12, as best shown in FIGS. 2C and 3. The light may then be reflected back out through the fret top surface or may be reflected through another fret surface. Other reflection method may occur as well. Reflection may occur if one or more of the fret side surfaces 16, upper bottom surface 18, or lower bottom surface 14 are not transparent or if they have a reflective quality about them. The light refractively or otherwise entering the fret may be reflected from the fret if holographic paper 20 is coupled to one or more fret surfaces, as best shown in FIGS. 2A and 2B. In one fret embodiment, light may not be substantially reflected by the fret or fret and holographic combination, but may only be substantially refracted in the fret.

When a holographic image is placed on or near a surface of the fret 10, or in at least one method, in or near another portion of the fret, the holographic image may be displayed to users of the instrument 100. For example, as best seen in FIGS. 2A and 2B, holographic paper having at least one holographic image may be coupled to at least one surface of the fret. As light enters the fret, the holographic image may be displayed within the fret one method, or may be broadcast outside the fret in one method.

One method may also contain the step of generating light on the neck 104, generally near the fret 10 and subsequently broadcasting or otherwise emanating the light through the fret. The light may be generated through the use of an optical fiber cable, also referred to as a fiber optic cable or simply fiber optic or optics, or an L.E.D. For example, in one method, a first end of a fiber optic cable or an LED may be placed proximal at least one fret. This may be done by embedding the LED or the cable into the neck 104. In one method, a second end of the fiber optic cable may be placed near an LED in the base 102 or on the neck. Or, a different light source such as, but not limited to, natural light, may be used as the fiber optic light source. In one method, the LED or other light source may be operated through the use of a switch. The switch may be found on the neck or the base. The light source may help broadcast the hologram in one method.

One method may also include steps of coupling the fret to the neck. In one method, an adhesive comprising a hardener and a resin is used. Upon obtaining the desired consistency and mixture properties, the adhesive is applied to at least one of the fret 10 and the neck 104 proximal where the fret will be placed on the neck. Upon applying the adhesive, the fret is placed on the neck. In one method, a second adhesive is used to couple holographic paper 20, as best shown in FIGS. 2A and 2B, to the fret. The second adhesive may be either similar or different to the fret adhesive.

One method may also include uncoupling a neck 104 having metal frets 10 from the body 102 on a Fender or generally similar model guitar and coupling a neck having mineral frets to the body. To do so, the strings 110 may be uncoupled from the neck. However, in one method, the strings may stay coupled to the neck and new strings may be coupled to the body. The method of uncoupling and coupling necks to the body may be done in order to facilitate a change in tone on a Fender model guitar, potentially allowing a Fender model to sound more closely related to a Les Paul Gibson model.

Alternative Embodiments

The embodiments of the mineral-fretted instrument, associated optical apparatus, and their perspective methods of use as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure.

One type of alternative embodiment may be comprised of a string instrument with various fret materials, randomly arranged or otherwise. For example, one embodiment may be comprised of a first mineral such as quartz, a second mineral such as turquoise, and a third material such as metal. The materials may be arranged so that each material is located in specific areas of the neck, or the materials may be arranged randomly on the neck as well.

Synthetic minerals may also be used in one embodiment.

An embodiment is contemplated which enables for quick replacement and exchange of guitar neck in order to easily swap between a Fender sound and a Gibson sound.

I claim:

1. An instrument comprising:
a body;
a neck comprising,
a first end having a headstock,
a fretboard,
at least one mineral fret coupled to the fretboard, and
a second end being one of coupled and integrated to the body,
a truss rod and a plurality of bores, at least one bore of the plurality of bores being disposed between the at least one mineral fret and the truss rod; and
a plurality of strings, each string comprising,
a first end operatively coupled to the body, and
a second end operatively coupled to the neck.

2. An instrument comprising:
a body;
a neck comprising,
a first end having a headstock,
a fretboard,
a fret coupled to the fretboard,
a holographic image, the holographic image being visible through the fret,
a second end coupled to the body; and
a plurality of strings, each string comprising,
a first end operatively coupled to the body,
a second end operatively coupled to the neck.

3. The instrument of claim 2, wherein the holographic image comprises holographic paper.

4. The instrument of claim 3, wherein the holographic paper resides between the fret and the fretboard.

5. The instrument of claim 3, wherein the holographic paper is operatively coupled to the fretboard.

6. The instrument of claim 3, wherein the fret is transparent or translucent.

7. The instrument of claim 2, wherein the fret comprises quartz.

8. The instrument of claim 2, wherein the fret is coupled to the fretboard using an adhesive composition, the adhesive composition comprising an amine, epichlorohydrin, and bisphenol A.

9. The instrument of claim 8, wherein the amine is selected from the group consisting of a polyoxyalkyleneamine and N-aminoethylpiperazine.

10. The instrument of claim 9, wherein the adhesive composition further comprises an alkyl glycidyl ether or an aryl glycidyl ether.

11. The instrument of claim 10, wherein the adhesive composition further comprises nonyl phenol.

12. The instrument of claim 2, wherein the fret is coupled to the fretboard using an adhesive composition resulting from reaction of a hardener comprising an amine with a resin comprising epichlorohydrin.

13. The instrument of claim 12, wherein the resin further comprises bisphenol A.

14. The instrument of claim 13, wherein the amine is selected from the group consisting of a polyoxyalkyleneamine and N-aminoethylpiperazine.

15. The instrument of claim 14, wherein the resin further comprises an alkyl glycidyl ether or an aryl glycidyl other.

16. The instrument of claim 15, wherein the hardener further comprises nonyl phenol.

17. The instrument of claim 2, wherein the mineral fret is coupled to the fretboard using CRYSTAL SHEEN™ polymer finish.

* * * * *